United States Patent [19]

Venaleck

[11] 4,084,585

[45] Apr. 18, 1978

[54] FACE MASK

[76] Inventor: Howard J. Venaleck, 5869 Hillside Dr., Watertown, N.Y. 13601

[21] Appl. No.: 758,658

[22] Filed: Jan. 12, 1977

[51] Int. Cl.[2] ..... A62B 23/00

[52] U.S. Cl. ..... 128/146.2; 128/146.7; 2/206; 46/1 F; 272/8 R; 273/DIG. 17

[58] Field of Search ..... 128/146, 146.2, 146.3, 128/146.4, 146.6, 146.7, 147, 140 R, 140 N, 132 R, 139, 136, 151, 205, 201; 2/206, 174; 46/1 F; 272/8 R, 8 N; 273/DIG. 17

[56] References Cited

U.S. PATENT DOCUMENTS

| | | | |
|---|---|---|---|
| D. 224,277 | 7/1972 | Venaleck | D29/8 |
| 843,486 | 2/1907 | Otto | 2/206 |
| 2,171,311 | 8/1939 | Moses | 2/206 |
| 2,667,869 | 2/1954 | D'Elia | 128/147 |

*Primary Examiner*—Robert W. Michell
*Assistant Examiner*—Henry J. Recla
*Attorney, Agent, or Firm*—Stonebraker, Shepard & Stephens

[57] ABSTRACT

A face mask cut from a sheet of foamed resin material has slits cut near each end shaped to curve inwardly in a U shape. The ends of the mask conform approximately to the U shape of the slits so that the material between the slits and the ends of the mask forms a pair of U-shaped ear loops. The ear loops are bendable in a one-half turn so that the U shapes extend outwardly away from the central portion of the mask for resiliently looping over the ears of the wearer to hold the mask in place.

9 Claims, 2 Drawing Figures

FACE MASK

BACKGROUND OF THE INVENTION

Disposable face masks that are die-cut from a thin sheet of resilient foamed resin material are generally known, and my previous design U.S. Pat. No. 224,277 shows a prior art version of such a mask. The masks are lightweight, comfortable, cheap, and effective as filters.

This invention involves recognition of a better way of forming such a mask to conserve material, fit a wider range of face sizes, and provide a larger central region for better coverage of the nose and mouth of the wearer, all without increasing the cost of the mask.

SUMMARY OF THE INVENTION

The inventive face mask is cut from a sheet of resilient, foamed resin material to have a central region amply shaped to cover the nose and mouth of the wearer. Each opposite end region of the mask has a slit spaced inwardly from the end of the mask and extending from upper to lower regions of the mask. A central portion of each of the slits is U-shaped and curves inward toward the central region of the mask, and the end regions of the mask are shaped to conform approximately with the slits so that material between the slits and the ends of the mask has an approximately uniform width and forms a pair of ear loops having U-shaped portions. The ear loops are bendable in a one-half turn to dispose the U-shaped portions to extend outwardly away from the central region for resiliently looping over the ears of the wearer to hold the mask in place. The mask is preferably insufficiently long to extend from ear to ear until the ear loops are bent outward, and the turned ear loops resiliently bias the mask to fit a range of face sizes. The end regions of the slits preferably curve inward toward the central region of the mask along the upper and lower regions of the mask, and the end regions of the slits preferably have substantially smaller radii of curvature than the U-shaped central portions of the slits. This helps direct the end regions of the ear loops along the upper and lower edges of the mask so that tension on the ear loops provides optimum support for the mask.

DRAWINGS

DETAILED DESCRIPTION

Figure 1:
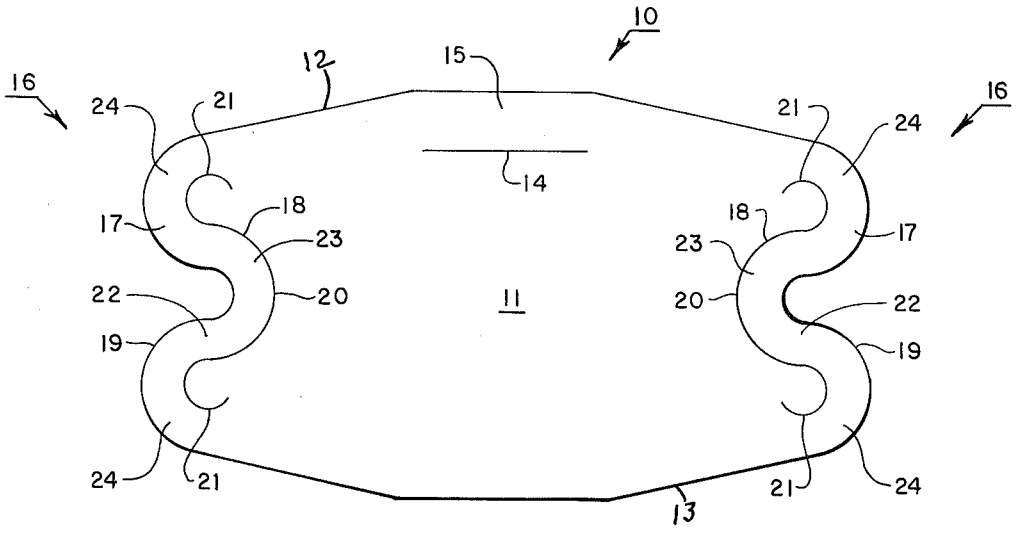
FIG. 1 is a plan view of a preferred embodiment of the inventive mask.

Mask 10, as shown in the drawings, is preferably die-cut from a thin sheet of resilient and foamed resin material that acts as a filter and readily bends over the face of the wearer. Central region 11 extends from upper edge 12 to lower edge 13 and is amply shaped to cover both the nose and mouth of the wearer. A nose slit 14 spaced below upper edge 12 forms a band 15 that is bendable under the wearer's nostrils to the position shown in FIG. 2 when the mask is worn. Then both central region 11 and band 15 filter air drawn through the wearer's nostrils for doubling the filtering capacity of the mask.

Ear loops 17 are formed at each of the end regions 16 of mask 10 by means of slits 18 spaced inward from end edges 19. Slits 18 extend from the upper to the lower regions of the mask, and the central portions of slits 18 are formed as U-shaped curves 20 oriented to curve inward toward central region 11 of the mask. The end regions of slits 18 curve inward toward the central region of mask in curvatures 21 that have substantially smaller radii of curvature than the U-shaped curvatures 20. Slits 18 are also preferably curvilinear and formed so as not to remove any material from mask 10.

The ends 19 of mask 10 are shaped to conform approximately with slits 18 so that the material 22 between slits 18 and end edges 19 has an approximately uniform width and forms a pair of ear loops having U-shaped portions 23. Ear loops 22 have ends 24 that curve away from U-shaped portions 23 and are directed along upper and lower edges of the mask to be integral with upper and lower regions of the mask. The end curves 21 of slits 18 help direct the stress from ear loops 22 along upper and lower edges of the mask for a good fit on the wearer.

Figure 2:
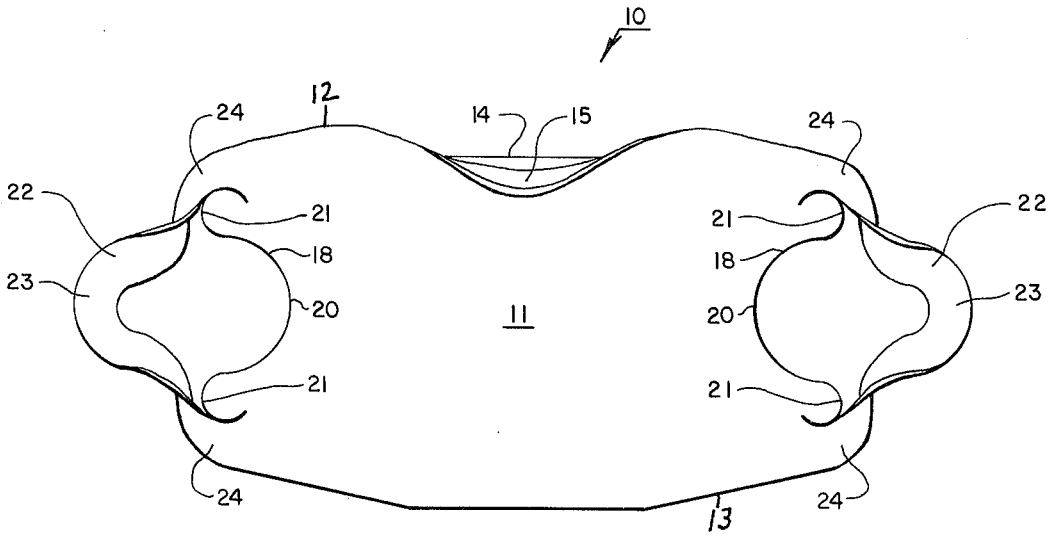
FIG. 2 is a plan view of the mask of FIG. 1 with the nose band and ear loops bent to fit onto the wearer.

Ear loops 22 are bent in a one-half turn to dispose the U-shaped portions 23 to extend outwardly away from the central region 11 of the mask as best shown in FIG. 2. The one-half bend of the ear loops 22 resiliently biases the loops to fit a range of face sizes, and in addition, the material of the mask is generally stretchable throughout the body of the mask and the ear loops 22 for further resilient adjustment to face sizes.

To fit the mask in place, the wearer grasps ear loops 22, gives them each a one-half bend as shown in FIG. 2, bends down the nostril band 15, fits his nose over band 15 and under the upper edge 12 of the mask, and stretches the ear loops 22 to fit over his ears. The mask is easily removed and disposable after use, and the bending and fitting of ear loops 22 in place is simple, convenient, and comfortable.

Forming ear loops 22 by curvilinear die-cuts 18 economizes on material by shortening the overall length of the mask and eliminating discard of any material from an ear-hole opening. Bendable ear loops 22 also have a better resilient bias than straight ear loops and make the mask fit a wider range of face sizes. The improved mask 10 also retains all the advantages of light weight, comfort, disposability, and effectiveness of the prior art mask.

What is claimed is:

1. A face mask shaped to cover the nose and mouth of the wearer, said face mask comprising:

a. a blank of resilient, foamed resin material having a central region and opposite end regions, each opposite end region of said mask having a slit spaced inward from the end of said mask;

b. each of said slits extending from upper to lower regions of said mask;

c. a central portion of each of said slits being U-shaped and curving inward toward said central region of said mask;

d. said end regions of said mask having a peripheral edge spaced approximately equidistant from said slits so said material between said slits and said ends of said mask has an approximately uniform width and forms a pair of ear loops having U-shaped portions; and e. said ear loops being bendable in a one-half turn to dispose said U-shaped portions to extend outwardly away from said central region for resiliently looping over the ears of the wearer to hold said mask in place.

2. The face mask of claim 1 wherein said slits are curvilinear, and none of said material is removed from said mask by said slits.

3. The face mask of claim 1 wherein said mask is insufficiently long to extend from ear to ear until said ear loops are disposed in said one-half turn, and said turned ear loops resiliently bias said mask to fit a range of face sizes.

4. The face mask of claim 1 wherein said mask has a nose slit centered between said end region slits along the upper edge of said mask to form a band bendable under the wearer's nostrils below said upper edge of said mask.

5. The face mask of claim 1 wherein the end regions of said slits curve inward toward said central region of said mask along upper and lower regions of said mask, and said end regions of said slits have substantially smaller radii of curvature than said U-shaped portions of said slits.

6. The face mask of claim 5 wherein end regions of said ear loops are integral with said upper and lower regions of said mask and are directed along said upper and lower edges of said mask.

7. The face mask of claim 5 wherein said slits are curvilinear, and none of said material is removed from said mask by said slits.

8. The face mask of claim 7 wherein said mask is insufficiently long to extend from ear to ear until said ear loops are disposed in said one-half turn, and said turned ear loops resiliently bias said mask to fit a range of face sizes.

9. The face mask of claim 8 wherein said mask has a nose slit centered between said end region slits along the upper edge of said mask to form a band bendable under the wearer's nostrils below said upper edge of said mask.

* * * * *